United States Patent [19]

Sepe

[11] Patent Number: 4,822,956

[45] Date of Patent: Apr. 18, 1989

[54] COAXIAL CABLE

[75] Inventor: Edmund N. Sepe, Ocean Township, N.J.

[73] Assignees: American Telephone and Telegraph Company, New York, N.Y.; AT&T Information Systems Inc., Morristown, N.J.

[21] Appl. No.: 895,203

[22] Filed: Aug. 11, 1986

[51] Int. Cl.[4] ..... H01B 11/18

[52] U.S. Cl. ..... 174/103; 174/36; 174/71 C; 174/72 A; 174/74 A; 174/DIG. 8

[58] Field of Search ..... 174/103, 71 R, 72 R, 174/72 A, 71 C, 74 A, DIG. 8, 36, 115, 32, 35 SM; 339/148; 439/623; 29/882

[56] References Cited

U.S. PATENT DOCUMENTS

| | | | |
|---|---|---|---|
| 1,370,731 | 3/1921 | Chase | 174/103 |
| 2,147,095 | 2/1939 | Hochstadter | 174/103 |
| 2,172,760 | 9/1939 | Rosch | 174/103 |
| 2,190,017 | 2/1940 | Del Mar | 174/103 |
| 2,243,851 | 6/1941 | Booth et al. | 174/103 |
| 2,440,290 | 4/1948 | Pickles | 174/34 |
| 2,889,394 | 6/1959 | Aune | 174/88 C |
| 3,322,889 | 5/1967 | Bird et al. | 174/103 |
| 3,408,455 | 10/1968 | Dannes | 174/71 R |
| 3,493,815 | 2/1970 | Hurtle | 174/102 R |
| 4,281,212 | 7/1981 | Bogese, II | 174/103 X |
| 4,311,871 | 1/1982 | Brunner et al. | 174/74 A |
| 4,358,636 | 11/1982 | Ijff et al. | 174/103 |
| 4,447,115 | 5/1984 | Guazzo et al. | 174/71 R X |
| 4,467,002 | 8/1984 | Crofts | 174/74 A X |
| 4,593,153 | 6/1986 | Kuhn et al. | 174/36 |

FOREIGN PATENT DOCUMENTS

| | | | |
|---|---|---|---|
| 943651 | 3/1974 | Canada | 174/115 |
| 943611 | 3/1949 | France | 174/103 |

*Primary Examiner*—Morris H. Nimmo

*Attorney, Agent, or Firm*—David H. Tannenbaum; David R. Padnes

[57] ABSTRACT

Electro-static discharge is a problem with high-speed data even when using coaxial cables. Primarily, this problem arises at the terminal ends of the circuit where connections are made using separate coaxial cables for connecting to various pieces of equipment thereby allowing voltages to be induced differently in each such cable. This problem can be overcome by combining a portion of each cable such that the shield around each signal carrying wire remains intact while also being solidly in contact with the shield from the other wire. The cable is constructed by removing the outer insulation from a section of two single coaxial cables, electrically connecting together the exposed shields of each cable at both ends of the exposed section and reinsulating the abutted cables so that the shields remain in contact along their entire length.

10 Claims, 2 Drawing Sheets

COAXIAL CABLE

BACKGROUND OF THE INVENTION

This invention relates to coaxial cables and, more particularly, to such cables which are arranged to handle communications in the face of high electro-magnetic developed voltages.

Coaxial cables are used in a wide variety of places for an even wider variety of communication purposes, particularly where high frequencies must be communicated from one point to another. Traditionally, such cables, because they have a ground plane surrounding the signal carrying wire, have been though of as protecting the signals from electro-magnetically induced interference. However, this turns out to be only partially true. In particular, in situations where a pair of signal carrying wires must work together, such as in a balanced communication system, any induced electro-magnetic voltage causes severe problems.

Attempts have been made to solve this problem by placing both signal carrying wires inside the same ground shield. This has worked partially well but still some problems continued to exist.

Another solution has been to run two coaxial cables together and place a wire ground plane shield around them both. Again, the results have been less than wholly satisfactory.

Accordingly, a need exists in the art for a solution to the problem without going to great expense and without significantly limiting the mobility and flexibility of the connection.

SUMMARY OF THE INVENTION

I have solved the electro-magnetic voltage induction problem discussed above by using two coaxial cables, each have its signal-carrying wire connected to one or the other of the balanced signals. The insulation s stripped from around the ground plane shields of each cable for most of the length of the cable. The shields of each wire are then forced into contact with each other and a clip is used at both bare ends of the shield to insure good electrical contact between the two shields. A shrinkable covering is then placed over the exposed shields so as to insure that they remain in contact with one another along their length. If the shield of a coaxial cable is not terminated properly to ground with a 360 degree connection shield, performance is compromised. This effect is well-known in the art. This would normally require a metal enclosure for the circuitry and expensive RF connectors on the coaxial wire. My arrangement allows the use of a non-metallic circuit enclosure and less restrictive termination of the coaxial shields by reducing the sensitivity to the treatment of the shield termination.

BRIEF DESCRIPTION OF THE DRAWINGS

These and other objects and features, together with the operation and utilization of the present invention, will be more apparent from the illustrative embodiment shown in conjunction with the drawings in which.

DETAILED DESCRIPTION

Figure 1:
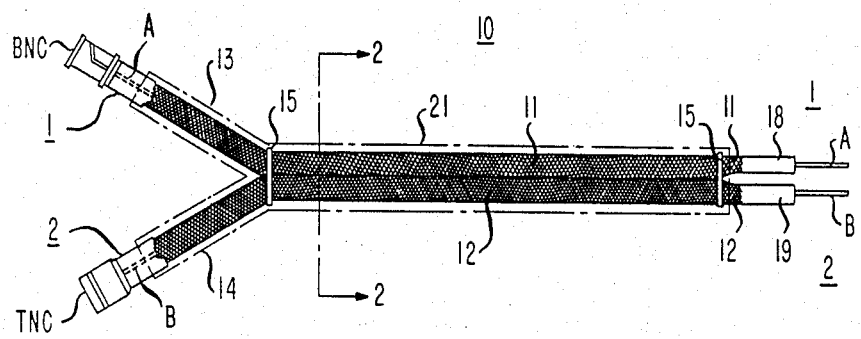
FIG. 1 shows a pair of coaxial cables connected together along their length.
Figure 2:
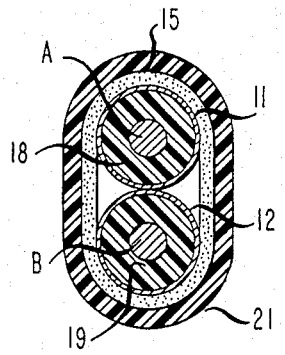
FIG. 2 shows a pictorial end view of the cables.

As shown in FIGS. 1 and 2, coaxial cables 1 and 2 each have an inner-conductor A and B which are traditionally used for signal carrying purposes. Around inner-conductor A and B is a layer of insulation 18 and 19. Around the insulation layer there is a metallic shield 11 and 12, and around the combined shields 11 and 12 there is an outside insulation layer 21 where shields 11 and 12 separate into individual legs, there is an insulation layer 13 (or 14) around each leg.

Figure 3:
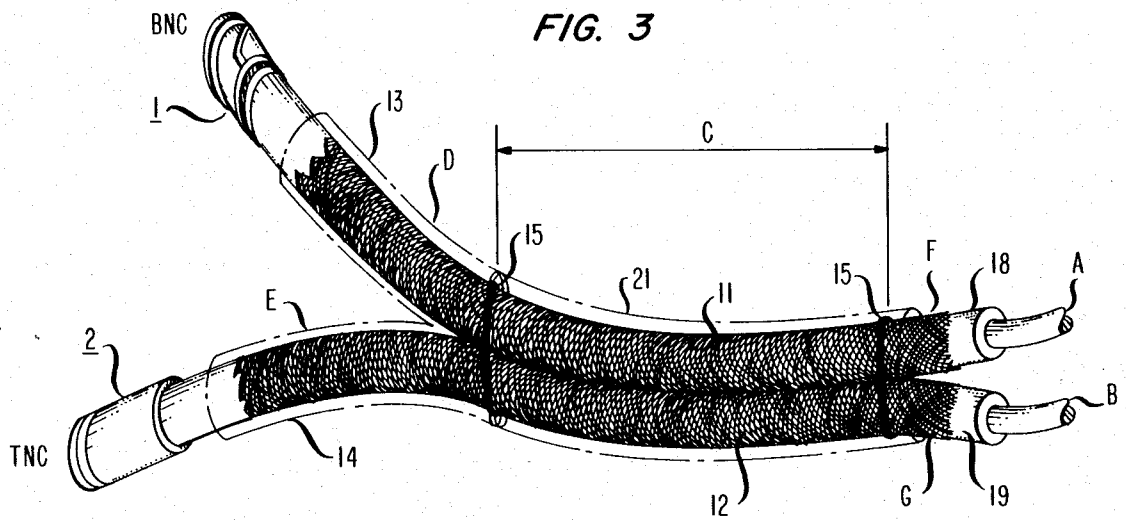
FIG. 3 shows an expansion of a portion of the cables.

Turning now to FIG. 3, it can be seen that a portion of the insulation has been stripped away in the region C of each of the coaxial cables and the metallic shields of both of the cables have been intermeshed with each other so as to maintain the metallic shield of cables 1 and 2 in contact with each other. To further enhance contact along the length of the exposed shields, there is added insulating material 21, preferably having heat-shrinkable characteristics. While the insulating covering is shown for clarity as being separated from the shields of the cable pair, in reality, the covering presses tightly against the shields thereby serving to maintain contact between shields 11 and 12 along the entire length of the exposed shields.

FIG. 3 shows an expanded view of the contact area, area C, of the exposed shields as contact is made along the exposed length. It should be noted that the shield exposure can either continue into the separated legs D and E or may end prior to the separation. Legs D and E should be about four inches and legs F and G (as measured from clip 15 to the end of inner-conductor A and B) should be about one inch. For practical purposes, the insulation should be stripped along most of the length of each shield so that the shield are in contact along their entire length except for the portion where the two conductors diverge for connection to their various plugs and sockets As shown in FIG. 1, insulation layers 13 and 14 will continue on the diverged legs.

Figure 4:
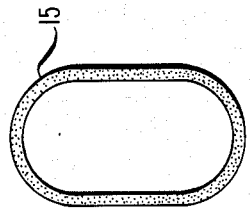
FIG. 4 shows an end view of the connection clip.

FIG. 4 is an end view of clip 15 prior to being crimped around the cables. This clip advantageously should be made from a conductive material to form an electrical bond between the two shields. This bond may be created by crimping or by soldering.

In operation, inner conductors A and B, shown on the right side of the cable pair 1 and 2 in FIG. 1, are connected to the circuit shown in co-pending patent application D. C. Smith Case 10, Ser. No. 895,224 filed Aug. 11, 1986, which applications have a common assignee and which patent application is hereby incorporated by reference herein, while the BNC and TNC connectors of the cable pair are connected to the respective connectors on the terminal equipment.

CONCLUSION

There are other possible methods of reducing the ESD inducted voltage problem. One such method could be the introduction of a drain conductor connecting the ground shield ends of the cables together, such as, for example, by a coaxial shield around the outside of the coaxial connectors, or an extra wire running down the outside of the coaxial pair.

What is claimed is:

1. A plurality of coaxial cables each having an inner conductor surrounded by insulating material which, in turn, is surrounded by a metallic wire mesh ground shield, the improvement comprising:

means for maintaining the ground shields of all of said cables in physical and electrical contact with one another, said physical and electrical contact being along a first predetermined distance, said first predetermined distance being a substantial portion of the entire length of each of said cables, and means for precluding contact of the ground shields of said cables with one another along a second predetermined distance, said second predetermined distance being substantially less than said first predetermined distance.

2. The invention set forth in claim 1 wherein said maintaining means includes a pair of electrically conductive clips positioned circumferentially around said shields, one of said clips being at each end of said first predetermined distance.

3. The invention set forth in claim 1 wherein said maintaining means includes a cover placed around said shields along said first predetermined distance.

4. A method of preparing a plurality of coaxial cables to minimize interference with signals carried by said plurality of cables, each of said plurality of cables having an inner conductor surrounded by insulation, said insulation, in turn, being surrounded by electrically conductive material forming a ground shield which, in turn, is surrounded by outer insulating material, said method comprising the steps of:

stripping said outer insulation material from a substantial length of each of said plurality of cables so as to expose a length of said ground shields of said cables, moving said exposed ground shield lengths into meshed contact with each other along said exposed length, and positioning a retaining clip around said exposed length thereby holding said meshed pairs in electrical contact with each other along said exposed length.

5. The method set forth in claim 4 further comprising the step of placing an outer covering around said exposed meshed cable along said exposed length.

6. The method set forth in claim 5 wherein said outer covering is heat shrinkable and said method further comprising the step of heat shrinking said outer covering.

7. A plurality of coaxial cables each having an inner conductor surrounded by insulating material which, in turn, is surrounded by a metallic ground shield, the improvement comprising:

means for electrically meshing said metallic grounds shields of said plurality of cables substantially along their length, and a plurality of clips, each attached to and surrounding said metallic ground shields, said clips being disposed beneath said meshing means and above said metallic ground shields, said clips additionally securing said metallic ground shields in contact with one another, whereby the magnitude of the difference in any ground shield current of said plurality of coaxial cables is reduced.

8. The invention set forth in claim 7 wherein said plurality of clips bring the ground shields of all of said cables into physical and electrical contact.

9. The invention set forth in claim 8 wherein said plurality of clips includes a pair of electrically conductive clips positioned circumferentially around said shields, one of said clips at each end of the length of said contact.

10. The invention set forth in claim 1 wherein said precluding contact means includes an insulating cover placed around each of said ground shields.

* * * * *